United States Patent [19]

Nakamura et al.

[11] Patent Number: 4,459,243

[45] Date of Patent: Jul. 10, 1984

[54] VARIABLE VENTURI-TYPE CARBURETOR

[75] Inventors: Norihiko Nakamura; Takaaki Itoh; Takashi Katou, all of Mishima; Yozo Ota, Chiryu; Toshiharu Morino, Kuwana, all of Japan

[73] Assignees: Toyota Jidosha Kabushiki Kaisha; Aisan Industry Co., Ltd., both of Japan

[21] Appl. No.: 407,115

[22] Filed: Aug. 11, 1982

[30] Foreign Application Priority Data

Dec. 28, 1981 [JP] Japan ..... 56-209791

[51] Int. Cl.[3] ..... F02M 9/06

[52] U.S. Cl. ..... 261/44 C; 261/DIG. 56

[58] Field of Search ..... 261/44 C, 44 B, DIG. 56

[56] References Cited

U.S. PATENT DOCUMENTS

| | | | |
|---|---|---|---|
| 2,062,496 | 12/1936 | Brokel | 261/44 B |
| 4,185,054 | 1/1980 | Nakamura et al. | 261/44 C |
| 4,264,537 | 4/1981 | Watanabe et al. | 261/44 C |
| 4,302,404 | 11/1981 | Nakamura et al. | 261/44 C |
| 4,302,405 | 11/1981 | Inoue et al. | 261/44 C |
| 4,305,893 | 12/1981 | Morino | 261/44 C |
| 4,371,478 | 2/1983 | Wada | 261/44 C |

*Primary Examiner*—Tim R. Miles

*Attorney, Agent, or Firm*—Finnegan, Henderson, Farabow, Garrett & Dunner

[57] ABSTRACT

A variable venturi-type carburetor comprising a suction piston which has a tip face defining a venturi portion. The tip face has a projecting tip face portion located upstream of the needle and projecting toward the venturi portion. A groove, extending along the axis of the intake passage of the carburetor, is formed on the projecting tip face portion. The projecting tip face portion has a V-shaped cross-section which expands from the groove toward the venturi portion. A projection, having a V-shaped cross-section, is formed on the inner wall of the intake passage, which faces the tip face of the intake passage, which faces the tip face of the suction piston. The projection enters into the V-shaped cross-section of the projecting tip face portion of the suction piston when the amount of air fed into the cylinder of the engine is small.

6 Claims, 7 Drawing Figures

VARIABLE VENTURI-TYPE CARBURETOR

BACKGROUND OF THE INVENTION

The present invention relates to a variable venturi-type carburetor.

The inventor has proposed a variable venturi-type carburetor having a raised wall which projects from the inner wall of the intake passage, which inner wall faces the tip face of the suction piston serving to change the cross-sectional area of the venturi portion of the carburetor in response to a change in the amount of air fed into the cylinder of the engine. In this carburetor, a D-shaped air inflow mouth is formed between the substantially straight extending tip edge of the raised wall and the substantially circular cross-section inner wall of the intake passage, and at least the upstream end portion of the tip face of the suction piston is shaped in a V-shaped cross-section which expands toward the venturi portion so that an approximately triangular-shaped air inflow opening is formed between the tip edge of the raised wall and the upstream end portion of the tip face of the suction piston when the amount of air fed into the cylinder of the engine is small. In this carburetor, as mentioned above, the air inflow opening has an approximately triangular shape when the amount of air fed into the cylinder of the engine is small so that the opening area of the air inflow opening is as proportional to the lift of the suction piston as possible in order to obtain the smooth movement of the suction piston when the amount of air fed into the cylinder of the engine is increased. However, in this carburetor, when the amount of air fed into the cylinder of the engine is small, since the cross-sectional area of the venturi portion formed at a position located downstream of the raised wall is considerably larger than the area of the above-mentioned triangular-shaped air inflow opening, air flowing into the venturi portion from the air inlet opening is decelerated in the venturi portion. This reduces the velocity of the air flowing around the nozzle, thereby making it difficult to sufficiently promote the vaporization of fuel fed from the nozzle.

SUMMARY OF THE INVENTION

An object of the present invention is to provide a variable venturi-type carburetor capable of promoting the vaporization of fuel fed from the nozzle by increasing the velocity of air flowing around the nozzle when the amount of air fed into the cylinder of the engine is small.

According to the present invention, there is provided a variable venturi-type carburetor comprising: an axially-extending intake passage formed in the carburetor and having an inner wall of an approximately circular cross-section; a suction piston transversely movable in said intake passage in response to a change in the amount of air flowing within said intake passage, said suction piston having a tip face which defines a venturi portion in said intake passage and has an upstream end portion; a nozzle arranged on the inner wall of said intake passage, which faces the tip face of said suction piston; a needle fixed onto the tip face of said suction piston and extending through said nozzle; a raised wall projecting from the inner wall of said intake passage, which faces the tip face of said suction piston, and having a substantially straight tip edge for defining an approximately D-shaped air inlet mouth between the tip edge of said raised wall and the inner wall of said intake passage, the tip face of said suction piston having an approximately V-shaped cross-section which expands toward said venturi portion for defining an approximately isosceles triangular air inlet opening between the upstream end portion of the tip face of said suction piston and the tip edge of said raised wall when the amount of air flowing within said intake passage is small; and a projection having an approximately V-shaped cross-section and projecting from the inner wall of said intake passage, which faces the tip face of said suction piston, said projection entering into the V-shaped cross-section of the tip face of said suction piston and creating a thin gap between said projection and the tip face of said suction piston when the amount of air flowing within said passage is small.

The present invention may be more fully understood from the description of a preferred embodiment of the invention set forth below, together with the accompanying drawings.

DESCRIPTION OF A PREFERRED EMBODIMENT

Figure 1:
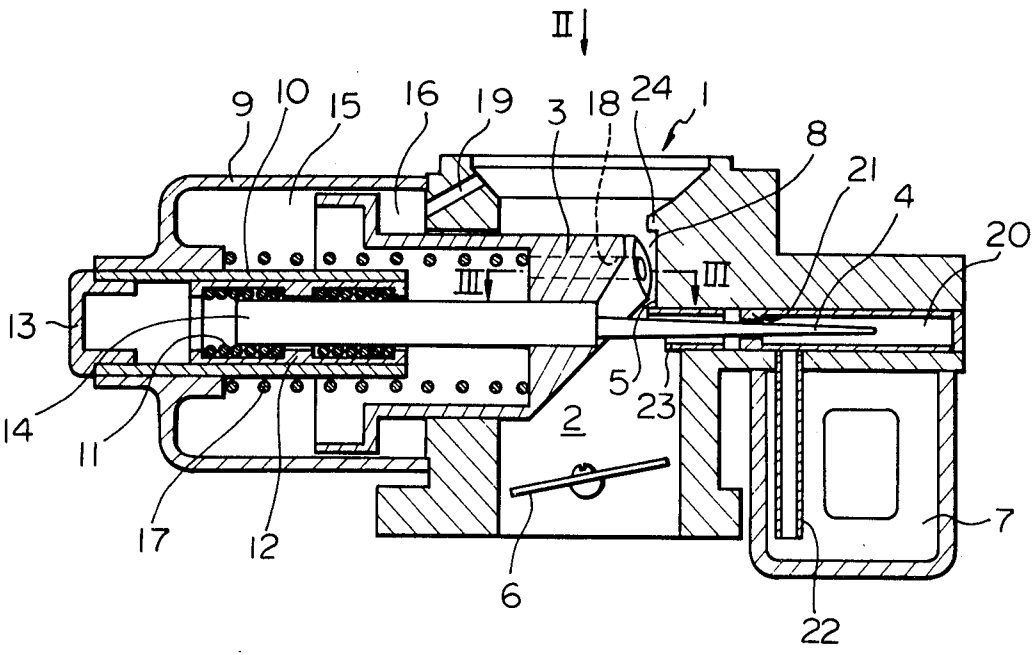
FIG. 1 is a cross-sectional side view of a variable venturi-type carburetor according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3, 5 designates a projection having a V-shaped cross-section and projecting toward the tip face of the suction piston 3 from the inner wall of the intake passage 2 opposite the tip face of the suction piston 3, 6 a throttle valve arranged in the intake passage 2 located downstream of the suction piston 3, and 7 a float chamber of the carburetor. A venturi portion 8 is formed between the projection 5 and the tip face of the suction piston 3.

A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. Guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

Fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the inner wall of the intake passage 2. The nozzle 23 projects from the inner wall of the projection 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

A raised wall 24, projecting horizontally into the intake passage 2, is formed at the upper end of the projection 5. A flow control is effected between the raised wall 24 and the tip end portion of the suction piston 3. When the engine is started, air flows downward within the intake passage 2. At this time, since the air flow is restricted between the scution piston 3 and the raised portion 24, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

Referring to FIGS. 4 through 7, the entire tip face portion A of the suction piston 3, which is located upstream of the needle 4, projects from a needle-mounting face 25 toward the tip of the needle 4, and the tip face portion B of the suction piston 3, which is located downstream of the needle 4, is inclined from the needle-mounting face 25 toward the vacuum chamber 15. Consequently, the tip face portion B forms an inclined surface directed downwards. As will be understood from FIGS. 6 and 7, the tip face portions A and B of the suction piston 3 have a symmetrical shape relative to a symmetrical plane a passing through the axis of the intake passage 2, and a groove 26, extending along the symmetrical plane a, is formed on the tip face portion A of the suction piston 3. The upstream end portion 26*a* of the groove 26 has a U-shaped cross-section and is located at a position near the tip of the needle 4 relative to the needle-mounting face 25. The remaining portion 26*b* of the groove 26 extends substantially straight from the upstream end portion 26*a* to the needle-mounting face 25. In addition, the tip face portion A of the suction piston 3 has a V-shaped cross-section which expands from the groove 26 toward the venturi portion 8 and, therefore, the tip face portion A of the suction piston 3 has a pair of inclined wall portions 27*a* and 27*b* each being inclined towards the groove 26.

Figure 3:
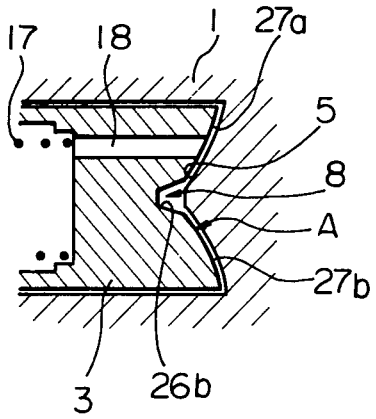
FIG. 3 is a cross-sectional view taken along the line III—III in FIG. 1.
Figure 4:
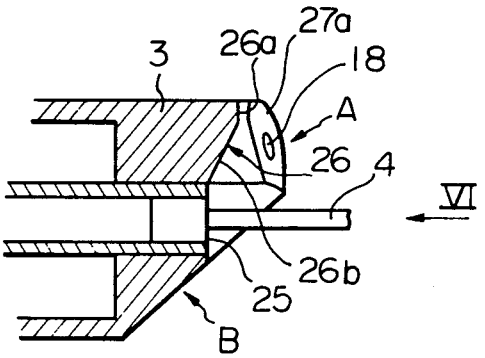
FIG. 4 is a cross-sectional side view of a portion of the suction piston illustrated in FIG. 1.
Figure 5:
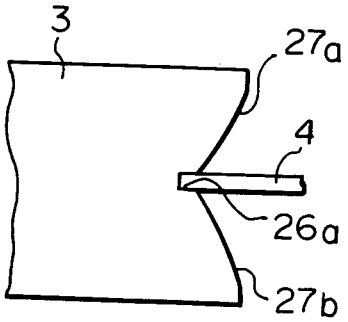
FIG. 5 is a plan view of FIG. 4.
Figure 6:
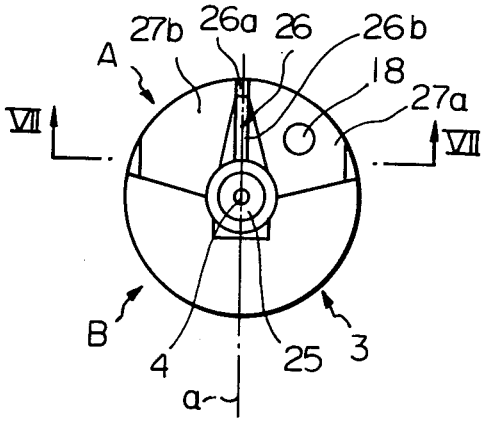
FIG. 6 is a front view of the tip face of the suction piston taken along the arrow VI in FIG. 4.
Figure 7:
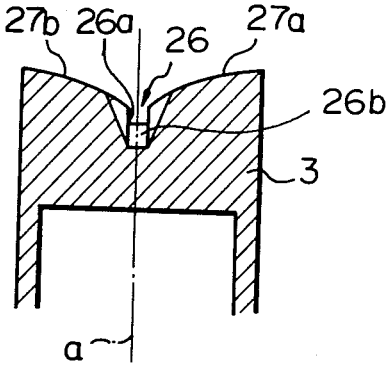
FIG. 7 is a cross-sectional view taken along the line VII—VII in FIG. 6.

As mentioned previously, the projection 5 having a V-shaped cross-section is formed on the inner wall of the intake passage 2 and extends between the raised wall 24 and the nozzle 23 as illustrated in FIG. 1. When the engine is operated under an idling state, the projection 5 enters into the V-shaped cross-section of the tip face portion A of the suction piston 3, as illustrated in FIG. 3, and creates a gap, having an approximately uniform width, between the tip face portion A of the suction piston 3 and the projection 5.

Figure 2:
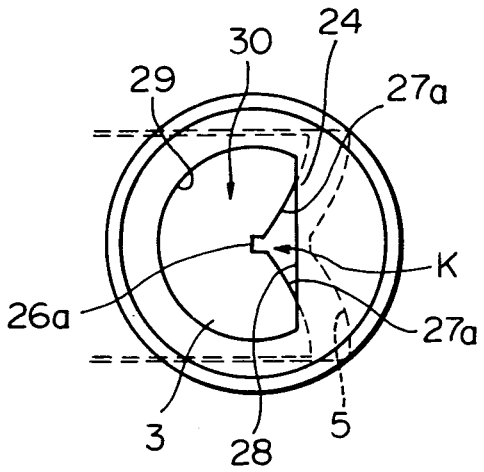
FIG. 2 is a plan view taken along the arrow II in FIG. 1.

As will be understood from FIG. 2, an approximately D-shaped air inlet mouth 30 is formed by the substantially straight extending tip edge 28 of the raised wall 24 and the approximately circular cross-section inner wall 29 of the intake passage 2 and, in addition, an approximately isosceles triangular-shaped air inflow opening K is formed by the tip edge 28 of the raised wall 24, the inclined wall portions 27*a*, 27*b*, and the upstream end portion 26*a* of the groove 26 when the amount of air fed into the cylinder of the engine is small. As mentioned above, by forming the suction piston 3 and the raised wall 24 so that the air inflow opening K has an approximately isosceles triangular shape when the amount of air fed into the cylinder of the engine is small, the suction piston 3 is able to smoothly move when the amount of air fed into the cylinder of the engine is increased or reduced. When the engine is operated under an idling state, since the tip face portion A of the suction piston 3 approaches the projection 5, a large part of the air fed into the venturi portion 8 from the air inflow opening K flows within the groove 26 having a small cross-sectional area. Consequently, the velocity of air flowing within the groove 26 becomes quite high. The air, flowing within the groove 26, flows across the tip of the nozzle 23 at a high speed and, thus, since fuel fed from the nozzle 23 is subjected to a strong shearing force, the vaporization of fuel is promoted. In addition, at this time, although a part of fuel fed from the nozzle 23 flows on the needle 4 toward the needle-mounting face 25, this part of fuel is also divided into fine particles by the air.

According to the present invention, it is possible to promote the vaporization of fuel when the amount of air fed into the cylinder of the engine is small, that is, particularly when the engine is operated under an idling state. Therefore, it is possible to obtain a stable idling operation of the engine.

While the invention has been described with reference to a specific embodiment chosen for purposes of illustration, it should be apparent that numerous modifications could be made thereto by those skilled in the art without departing from the basic concept and scope of the invention.

We claim:

1. In a variable venturi carburetor having an axially-extending intake passage of substantially circular cross-section, a suction piston movable transverse said intake passage in response to changes in air flow through said intake passage, said suction piston having a tip face defining a venturi portion in said intake passage and said tip face having an upstream end, a nozzle in the inner wall of said intake passage opposite said tip face, and a needle centrally fixed to and extending from said tip face and extending into said nozzle, the improvement comprising:

(a) a raised wall projecting from the inner wall of said intake passage opposite said tip face, said raised wall being upstream and adjacent said suction piston and having a substantially straight tip edge defining a substantially D-shaped air inlet mouth in said intake passage;

(b) a tip face portion between the upstream end of said tip face and said needle projecting from said tip face and extending between said raised wall and said nozzle when said suction piston moves toward said venturi portion, said tip face portion having a substantially V-shaped cross-section expanding toward said venturi portion and cooperating with the tip edge of said raised wall as said suction piston moves toward said venturi portion for defining a substantially isosceles triangular air inlet opening when the amount of air flowing within said intake passage is small; and (c) a projection having a substantially V-shaped cross-section projecting from the inner wall of said intake passage opposite said tip face portion, said projection mating with said tip face portion for creating a thin gap between said projection and said tip face portion when the amount of air flowing within said intake passage is small.

2. A variable venturi-type carburetor according to claim 1, wherein the tip face of said suction piston has a groove extending in the axial direction of said intake passage, the V-shaped cross-section of the tip face portion expanding from said groove toward said venturi portion.

3. A variable venturi-type carburetor according to claim 2, wherein said groove extends from the upstream end of the tip face of said suction piston to said nozzle.

4. A variable venturi-type carburetor according to claim 3, wherein said groove comprises an upstream portion which has a V-shaped cross-section and is open to said intake passage located upstream of said suction piston, and an downstream portion which has a bottom inclined toward said needle from said upstream portion.

5. A variable venturi-type carburetor according to claim 4, wherein the downstream portion of said groove has a V-shaped cross-section having a cross-sectional area which is gradually increased toward said needle.

6. A variable venturi-type carburetor according to claim 1, wherein said nozzle projects from said projection toward the tip face of said suction piston.

* * * * *